US007735666B2

(12) United States Patent
Niwa et al.

(10) Patent No.: US 7,735,666 B2
(45) Date of Patent: Jun. 15, 2010

(54) OPEN/CLOSE CAP AND MANUFACTURING METHOD THEREOF

(75) Inventors: Susumu Niwa, Tokyo (JP); Kouichi Inoue, Tokyo (JP); Toshikazu Kenmotsu, Tokyo (JP); Hiroaki Takashima, Toyama (JP); Kazuhiro Umenaka, Tokyo (JP)

(73) Assignee: Hosokawa Yoko Co., Ltd., Tokyo (JP)

( * ) Notice: Subject to any disclaimer, the term of this patent is extended or adjusted under 35 U.S.C. 154(b) by 477 days.

(21) Appl. No.: 10/591,848

(22) PCT Filed: Mar. 18, 2005

(86) PCT No.: PCT/JP2005/004912

§ 371 (c)(1),
(2), (4) Date: Sep. 5, 2006

(87) PCT Pub. No.: WO2005/090182

PCT Pub. Date: Sep. 29, 2005

(65) Prior Publication Data

US 2007/0108154 A1 May 17, 2007

(30) Foreign Application Priority Data

Mar. 22, 2004 (JP) ..... 2004-083529
Jul. 2, 2004 (JP) ..... 2004-196334

(51) Int. Cl.

| | |
|---|---|
| ***B65D 39/00*** | (2006.01) |
| ***B65D 41/00*** | (2006.01) |
| ***B65D 43/00*** | (2006.01) |
| ***B65D 47/00*** | (2006.01) |
| ***B65D 53/00*** | (2006.01) |
| ***B65D 41/02*** | (2006.01) |
| ***B65D 41/32*** | (2006.01) |

(52) U.S. Cl. ..... 215/252; 215/253; 215/256; 215/344; 215/901; 220/265; 220/266

(58) Field of Classification Search ..... 215/252, 215/224, 258, 253, 256, 344, 901; 220/265, 220/266

See application file for complete search history.

(56) References Cited

U.S. PATENT DOCUMENTS 4,343,408 A * 8/1982 Csaszar ..... 215/258

(Continued)

FOREIGN PATENT DOCUMENTS

EP 0679584 11/1995

(Continued)

OTHER PUBLICATIONS

European Patent Office issued an European Search report on Dec. 4, 2008, Application No. 05721099.

*Primary Examiner*—Anthony Stashick
*Assistant Examiner*—Andrew T Kirsch
(74) *Attorney, Agent, or Firm*—Young & Thompson

(57) ABSTRACT

A coupling piece coupling a cap body and a band is prevented from being cut off to tampering and the cutting-off thereof due to deformation of the band. An open/close cap a cap body to be screwed to an outer peripheral surface of a mouth portion of a pouring spout and a band extending in the circumferential direction of the cap body and engaged with the pouring spout, the band being formed with at least one portion at which the band 10 circumferentially separated, the end of the band being connected by a connection piece at that portion at which the band is cut off. The band is disposed below the lower surface of the cap body and coupling pieces are attached to the lower portion of the cap body. A band shape maintaining member is disposed to the lower end of the cap body.

14 Claims, 16 Drawing Sheets

U.S. PATENT DOCUMENTS 4,503,986 A * 3/1985 Nixdorff et al. ..... 215/252
4,657,153 A 4/1987 Hayes
5,056,675 A * 10/1991 Julian ..... 215/252
5,244,107 A * 9/1993 Battegazzore ..... 215/252
5,415,307 A * 5/1995 Kneer ..... 215/256
5,573,128 A * 11/1996 Tsujiguchi et al. ..... 215/252
5,676,269 A * 10/1997 Blake et al. ..... 215/252
5,715,959 A * 2/1998 Pfefferkorn et al. ..... 215/252

FOREIGN PATENT DOCUMENTS

JP 05-124669 5/1993
JP 08-198288 8/1996
JP 9150845 6/1997
JP 2004-51195 2/2004

* cited by examiner (a)

(b)

(a)

(b)

(c)

OPEN/CLOSE CAP AND MANUFACTURING METHOD THEREOF

TECHNICAL FIELD

The present invention relates to an open/close cap mounted to a mouth portion of a pouring spout of a packaging container or like for opening or closing the mouth portion of the pouring spout of the packaging container and also relates to a method of manufacturing such an open/close cap.

BACKGROUND TECHNOLOGY

In order to open or close the cylindrical pouring spout formed to a packaging container, there is provided a mouth plug structure in which an open/close cap is screw-engaged with a mouth portion of the pouring spout to be detachably. With such mouth plug structure, in order to surely hold the open/close cap to the pouring spout, there is known a structure in which a band is provided around the cap body so as to hold the outer surface of the pouring spout by the band (for example, refer to the following Patent Publication 1).

The open/close cap of such structure is constructed such that the band is disposed on the outer side of the cap body and the band is connected to the cap body by means of coupling piece. Further, the band is composed of a plurality of circular-arc-shaped band pieces which are connected to each other through a connection piece. Engaging pieces projecting toward inside are formed to the end portions in the circumferential direction of the inner surfaces of the respective band pieces, and these engaging pieces are engaged with the peripheral surface of the pouring spout of the open/close cap to thereby hold the cap to the pouring spout.

On the other hand, to the outer peripheral portion of the pouring spout, there is formed a claw portion projecting radially outward. When the cap is opened, the claw portion applies a load to the coupling pieces and the connection pieces to cut them off. That is, when the cap is rotated, the engaging pieces formed to the inner surfaces of the band pieces are engaged with the claw portions, and when the engaging piece is engaged with the claw portion, the load is applied to the coupling piece and the connection piece, thus cutting them off. According to such operation, engaging force of the engaging pieces to the pouring spout is loosened and the cap is therefore freely rotated around the outer periphery of the pouring spout.

The cap of such character is not opened when the coupling pieces and connection pieces are not cut off and the band pieces are mutually connected, and when the cut condition is observed, it is found that the cap has been once opened. This function will serve as tampering prevention function for preventing the inner content from tampering with mischief to the packaging container.

Furthermore, an open/close cap disclosed in the Patent Publication 2 is constructed such that a band is disposed below a cap body so that the band is connected to the cap body through a coupling piece. The band of this open/close cap is formed with two cut-off portions in its circumferential direction so as to be dividable into two pieces or parts in the circumferential direction. The rear portions of the respective band pieces in the cap opening direction are connected to the cap body through the coupling pieces.

With this open/close cap, a projection provided for the inner surface of each band piece is engaged with a ratchet formed to the outer peripheral surface of the mouth portion of a container to thereby prevent the open/close cap from being rotated in the cap opening direction. On the other hand, when the open/close cap is rotated in the cap opening direction, the projection rides over the ratchet. In this instance, a load is applied to the band, and the cut-out portions connecting the band pieces are cut off.

As mentioned above, by confirming whether the band is cut off or not, the invention disclosed in the Patent Publication 2 can judge whether the cap is opened or not.

Patent Publication 1: Japanese Patent Laid-open Application Publication No. HEI 5-124669

Patent Publication 2: Japanese Patent Laid-open Application Publication No. 2004-51195

However, after the pouring spout of the container has been tightly sealed by the open/close cap, when an external force is applied to the container during a conveyance in a conveyance line or circulation path, there is a fear of the coupling piece and connection piece being cut off. Especially, when the coupling piece has been cut off, the tampering prevention function has not been achieved.

In addition, in the conventional open/close cap represented by the invention of the Patent Publication 2, as shown in FIG. 20, for example, when the caps collide with each other during the conveyance of the containers, there were some cases that the band 100 is pushed inward and then deformed in the radially inward direction. When the caps are left in such deformed state, the cut-out portions 101 connecting the band pieces 100 might be cut off by the radially inward impact, thus damaging the rotation prevention function and opening checking function of the band (band piece) 100. Further, in FIG. 20, reference numeral 102 denotes a projection or protruded portion to be engaged with the ratchet.

DISCLOSURE OF THE INVENTION

Then, the present invention provides an open/close cap and a manufacturing method thereof capable of preventing the cutting-off of the coupling piece coupling the cap body and the band, ensuring the tampering prevention function and preventing the cutting-off due to the deformation of the band.

In the present invention, in order to solve the above problem, there is provided an open/close cap comprising a cap body screwed to an outer peripheral surface of a pouring spout of a packaging container and adapted to open the mouth portion and a band attached to the cap body so as to extend in a circumferential direction thereof so as to be engaged with the pouring spout, wherein the band is provided with at least one portion for separating the band in the circumferential direction, the separated band pieces are connected to each other by connection pieces, which are to be cut off, at that one portion, a protruded portion is formed to an inside of the band so as to project toward the pouring spout, when the open/close cap is rotated in an opening direction with respect to the pouring spout, forward sides of the band pieces between which the connection piece is snapped are rotated together with the cap body, and on the other hand, rear sides of the band pieces are prevented from rotating by engagement of the protruded portion with a portion of the pouring spout, the connection pieces are cut off by a stress of the band generated by the engagement, and the band is positioned below the lower surface of the cap body so as to be attached to the lower portion of the cap body by a coupling piece. Further, it is preferred that the band includes more than two pieces extending in the circumferential direction and coupled by the coupling pieces together.

In the present invention, it is characterized in that the coupling piece connects the inner surface side of the band and the lower surface of the cap body.

Furthermore, a contact preventing portion having a diameter equal to at least an outer surface of the band is provided for the outer peripheral surface of the cap body so as to extend outward from the outer peripheral surface.

Furthermore, in the present invention, the contact preventing portion is formed by extending at least a lower portion in a vertical direction of the cap body.

Further, in the present invention, in order to solve the above problem, a band shape maintaining member for preventing crushing of the band in a radially inward direction due to abutment of the inside portion of the band is disposed to the lower end of the cap body in an inside portion of the band.

Further, it may be possible to adopt a structure in which the band shape maintaining member is composed of a plurality of projections intermittently disposed to the lower end surface of the cap body in a circumferential direction thereof or the band shape maintaining member is an annular member projected from the lower end of the cap body.

In the present invention, the cap body, the band shape maintaining member, the band, the connection piece and the coupling piece are integrally formed through an injection molding process.

Furthermore, the present invention is characterized in that a contact preventing portion having a diameter equal to at least an outer surface of the band is provided for the outer peripheral surface of the cap body so as to extend outward from the outer peripheral surface.

Still furthermore, in the present invention, in order to solve the above problem, there is adopted a method of manufacturing an open/close cap which comprises a cap body screwed to an outer peripheral surface of a pouring spout of a packaging container so as to open or close the pouring spout, a band disposed so as to extend in the circumferential direction of the cap body and coupled to the cap body through a coupling piece, and a band shape maintaining member disposed to a lower portion of the cap body for preventing crushing of the band in a radially inward direction due to abutment of the inside portion of the band, and in which the band is provided, in a circumferential direction thereof, with at least one portion at which the band is separated into band pieces in the circumferential direction, and at which the band pieces are connected to each other by a connection piece, and the connection piece is cut off by a stress caused at a time when the open/close cap is rotated with respect to the pouring spout and a protruded portion projecting toward the pouring spout from the inside of the band rides over a portion of the pouring spout, the manufacturing method including an injection molding step for integrally molding the cap body, the band shape maintaining member, the connection piece and the coupling piece, wherein in the injection molding step, the band is connected to the cap body by the coupling piece so that a gap between the upper end of the band and the lower end of the cap body is formed to be larger than a dimension between the lower end of the band shape maintaining member and the lower end of the cap body, and also including a pushing step for pushing the band toward the cap body, after the injection of the injection molding step, so that the band is positioned on the outer peripheral side of the band shape maintaining member.

According to the present invention, since the band is positioned below the lower surface of the cap body and connected by the coupling piece, the contacting of a foreign material to the coupling piece can be effectively prevented. Especially, the arrangement of the coupling piece on the inner surface side of the band prevents the further contacting thereto. In addition, in the present invention, since the contact preventing portion is provided to the cap body, this contact preventing portion can prevent the contacting of the foreign material to the band itself.

As a result, even if the open/close cap is subjected to the external force on the conveyance line or flow passage, the band can be prevented from being damaged, and after providing in a market, the tampering prevention function can be surely achieved.

Furthermore, according to the present invention, in the case where the band is pushed radially inward of the open/close cap, the band abuts against the band shape maintaining member to thereby prevent the band from deforming. For this reason, even if another open/close cap or foreign material collide with the band, any stress is not applied to the connection piece, so that the connection piece is not broken.

Accordingly, the loosening preventing function, the tampering preventing function and the tampering confirming function naturally provided for the open/close cap can be achieved.

REFERENCE NUMERAL

Figure 1:
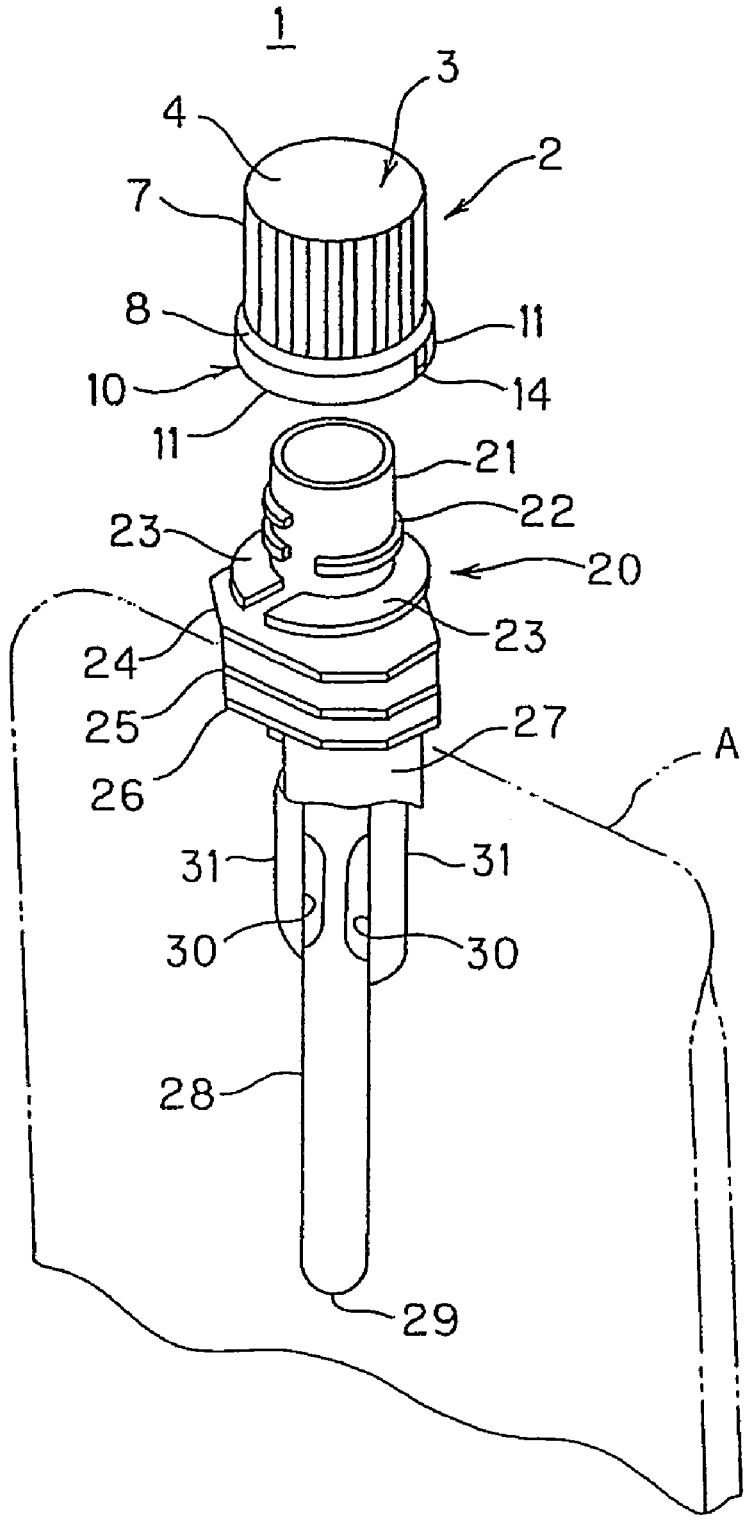
FIG. 1 is a perspective view of a mouth plug unit to which an open/close cap according to one embodiment of the present invention is attached.

1 - - - mouth plug unit
2, 2A, 2B - - - open/close cap
3 - - - cap body
7, 50, 60 - - - rib
8 - - - contact preventing portion
9, 9A - - - band-shape maintaining portion
10 - - - band
11 - - - band piece
12, 13 - - - coupling piece
14 - - - connection piece
15, 16 - - - claw portion
17, 18 - - - protruded portion (projection)
20 - - - pouring spout
21 - - - mouth portion
23 - - - stopper
40, 42, 44, 46 - - - rib
41, 43 - - - ratchet
45 - - - deformation prevention portion

BEST MODE FOR EMBODYING THE INVENTION

Hereunder, preferred embodiments of the present invention will be described with reference to the accompanying drawings.

FIG. 1 is a perspective view showing a mouth plug unit 1 sealing the pouring spout 20 of a container A with an open/close cap 2 according to one embodiment of the present invention. This mouth plug unit 1 includes a pouring spout 20 mounted to an upper portion of the container A and the open/close cap 2 formed to the upper portion of the pouring spout 20 so as to be screw-engaged with a mouth portion 21 for opening and closing the pouring spout 20. The mouth plug unit 1 is mounted to the upper end of the container A by inserting a lower portion of the pouring spout 20 into the container A. As viewed from an upper portion of the open/close cap 2, when the open/close cap 2 is rotated in the clockwise direction, the cap 2 is screwed downward with the pouring spout 20 and the mouth plug unit 1 seals the mouth portion 21, and on the contrary, when the cap 2 is rotated in the counterclockwise direction, the open/close cap 2 is disengaged from the pouring spout 20.

Figure 2:
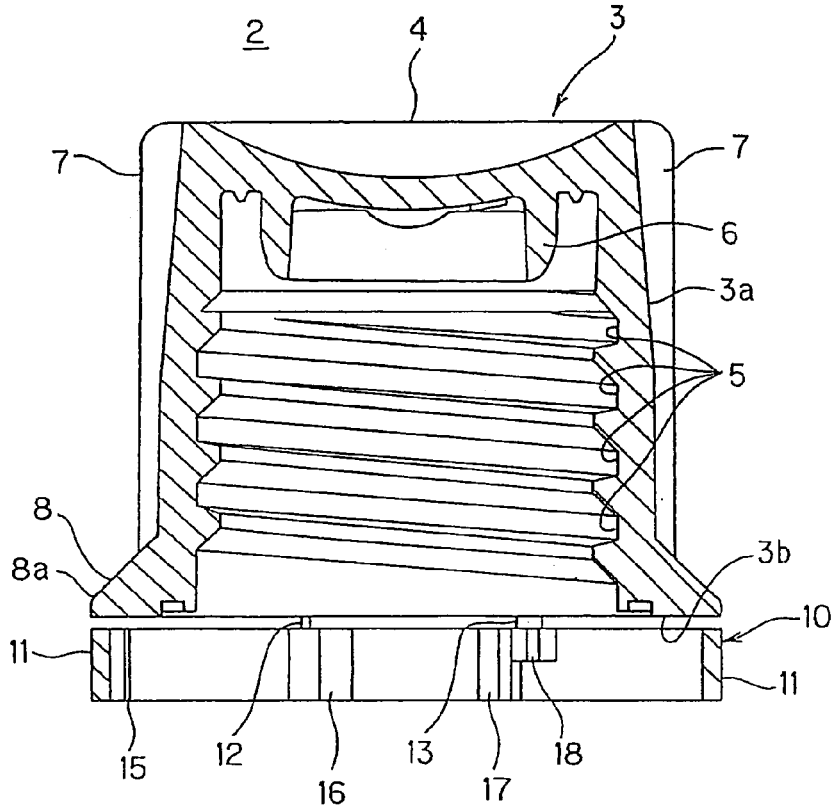
FIG. 2 is an elevational section of the open/close cap.
Figure 3:
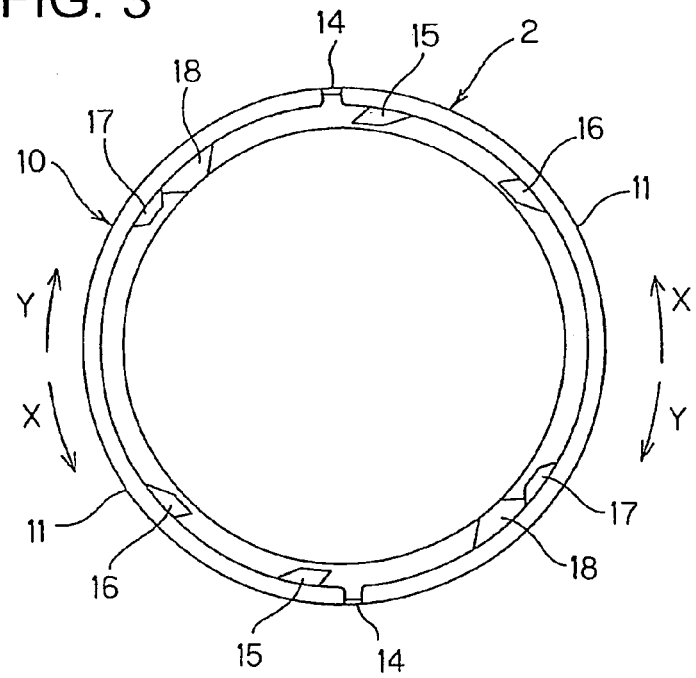
FIG. 3 is a view showing a positional relationship between claw portions and protruded portions (projections) formed to a band of the open/close cap.
Figure 4:
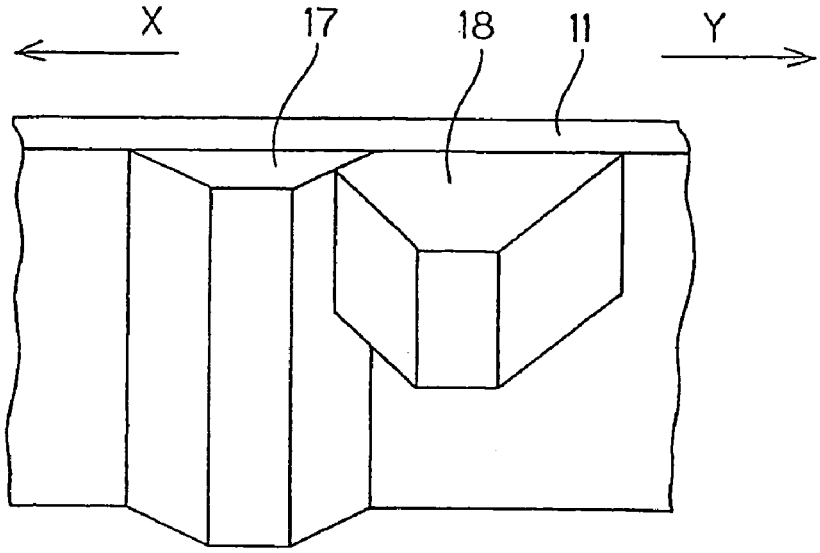
FIG. 4 is a perspective view showing a positional relationship between a high protruded portion and a low protruded portion.

FIGS. 2 to 4 show the details of the open/close cap 2.

The open/close cap 2 is composed of a tubular cap body 3 and a band 10 provided at the lower end of the cap body 3 so as to extend in the circumferential direction of the cap 2.

The cap body 3 is formed from a tubular member having a closed upper surface 4 and an opened lower portion. A screw-shaped male screw 5 is formed in an inner surface of the cap body 3 so as to be engageable with the outer peripheral surface of the mouth portion 21. A tubular seal portion 6 is formed to the inner surface of the upper portion 4 of the cap body 3 radially inside an inner wall portion of the cap body 3 so as to extend downward. This seal portion 6 serves to prevent the inner content from leaking by tightly contacting the outer peripheral surface of the seal portion to the inner surface of the mouth portion at a time when the open/close cap 2 is screw-engaged with the mouth portion 21. Ribs 7 are formed to the entire outer peripheral surface of the cap body 3 so as to project radially outward.

To the lower portion of the cap body 3, there is formed a contact preventing portion 8. This contact preventing portion 8 has a lower portion protruding radially outward, and an outer surface 8*a* thereof is inclined obliquely downward.

On the other hand, the band 10 is disposed below the lower end surface 3*b* of the cap body 3 and connected to the lower end surface 3*b* of the cap body 3 through coupling pieces 12 and 13. The band 10 is divided into two pieces 11, 11 at its circumferential direction, and these pieces 11 are connected, at their circumferential ends, to each other by means of connection pieces 14. The band pieces 11, 11 constituting the band 10 are coupled to the lower end surface 3*b* of the open/close cap 2 by means of coupling pieces 12 and 13 at circumferentially two portions of the band 10. The coupling pieces 12 and 13 are disposed on the inner periphery side of the band pieces 11, 11.

Among the coupling pieces 12 and 13 provided for the respective band pieces 11, 11, the coupling piece 12 disposed on the front side in a cap loosening (i.e. cap opening) direction X has thin thickness and narrow width so as to be easily cut off at a time when the open/close cap 2 is rotated. On the contrary, the other coupling piece 13 disposed on the rear side in the cap loosening direction X has large thickness and wide width so as not to be cut off even if the open/close cap 2 is rotated.

In addition, claw portions 15 and 16 are formed to the inner peripheral surface of each of the band pieces 11. One of the claw portions 15 is disposed on the front end portion in the cap loosening direction X and the other claw portion 16 is disposed slightly rear side of the claw portion 15 in the cap loosening direction X. These claw portions 15, 15 and 16, 16 formed to the respective band pieces 11, 11 are positioned symmetrically with each other. The claw portions 15 and 16 are protruded from the inner surfaces of the band pieces 11 so as to be slightly inclined in the cap loosening direction X with respect to the radial direction directed to the center axis of the open/close cap 2 from the inner surface of the band pieces 11.

Moreover, these band pieces 15 and 16 are formed with two trapezoidal protruded portions 17 and 18 so as to be as if overlapped with each other. These protruded portions 17 and 18 project from the inner surfaces of the band pieces 11, 11 radially toward the center axis of the open/close cap 2. These protruded portions 17, 17 and 18, 18 are also arranged to be symmetrical with each other. Furthermore, the claw portion 16 disposed on the rear side in the cap loosening direction X and the coupling piece 12 having thin thickness and narrow width are coincident with each other in their positions in the circumferential direction, and the protruded portions 17, 18 and the other coupling piece 13 are also coincident with each other in their positions in the circumferential direction.

FIG. 4 shows the positional relationship between two protruded portions 17 and 18 and the details of the shapes thereof. As shown in FIG. 4, the protruded portions 17 and 18 are combination of the protruded portion 17 having a low mount shape and the protruded portion 18 having a high mount shape. The low protruded portion 17 positioned on the front side in the cap loosening direction X is formed throughout the height direction of the band piece 11. On the other hand, the high protruded portion 18 positioned on the rear side in the cap loosening direction X is formed to an upper half portion in the height direction of the band piece 11.

The low protruded portion 17 abuts against a deformation preventing portion forming the front end portion of a rib formed to the mouth plug unit 1, which will be mentioned hereinafter so as to prevent the band piece from being deformed radially inward. On the other hand, the high protruded portion 18 has a function of displacing the band pieces after the cutting off of the connection pieces 14 at the time of riding over the ratchet during the rotation of the cap, which will be also mentioned hereinafter in detail. Further, the protruded portions 17 and 18 are formed so as to provide the trapezoidal shapes, respectively, and the front surfaces of the protruded portions 17 and 18 are formed so as to properly abut against the front end surfaces of the deformation prevention portions and not to be engaged with the ratchets at the time when the protruded portions 17 and 18 pass the positions of the ratchets. These protruded portions 17 and 18 are formed so that adjacent side portions thereof are partially overlapped with each other.

Figure 5:
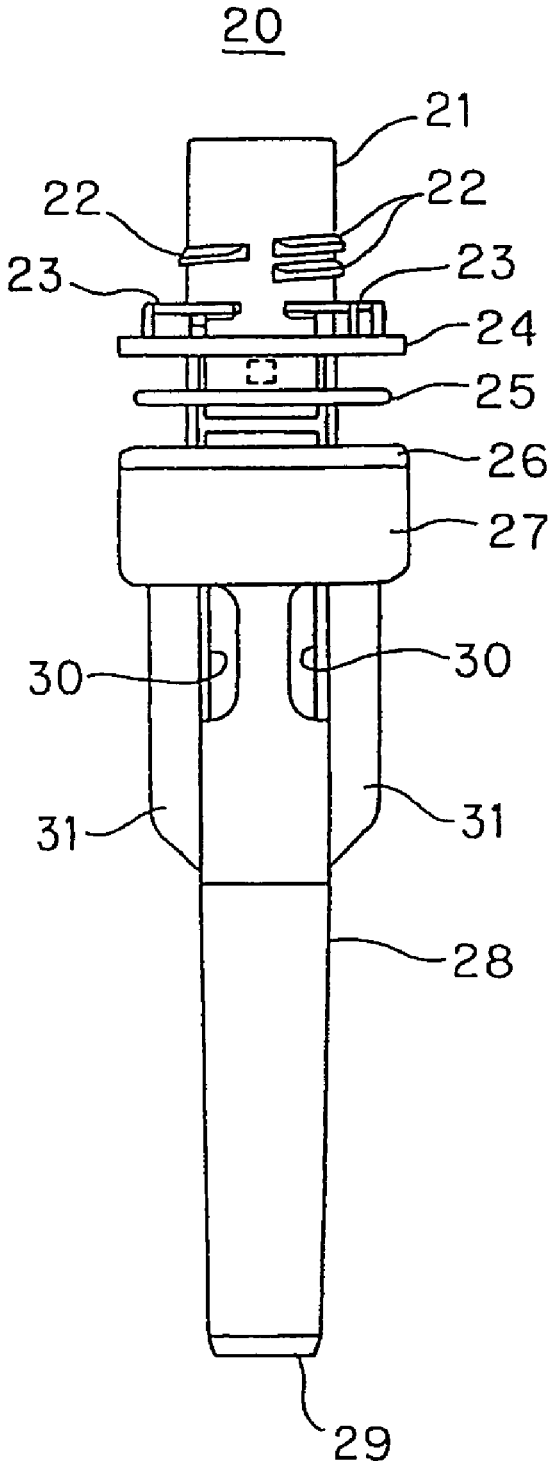
FIG. 5 is a front view of a pouring spout constituting the mouth plug unit.
Figure 6:
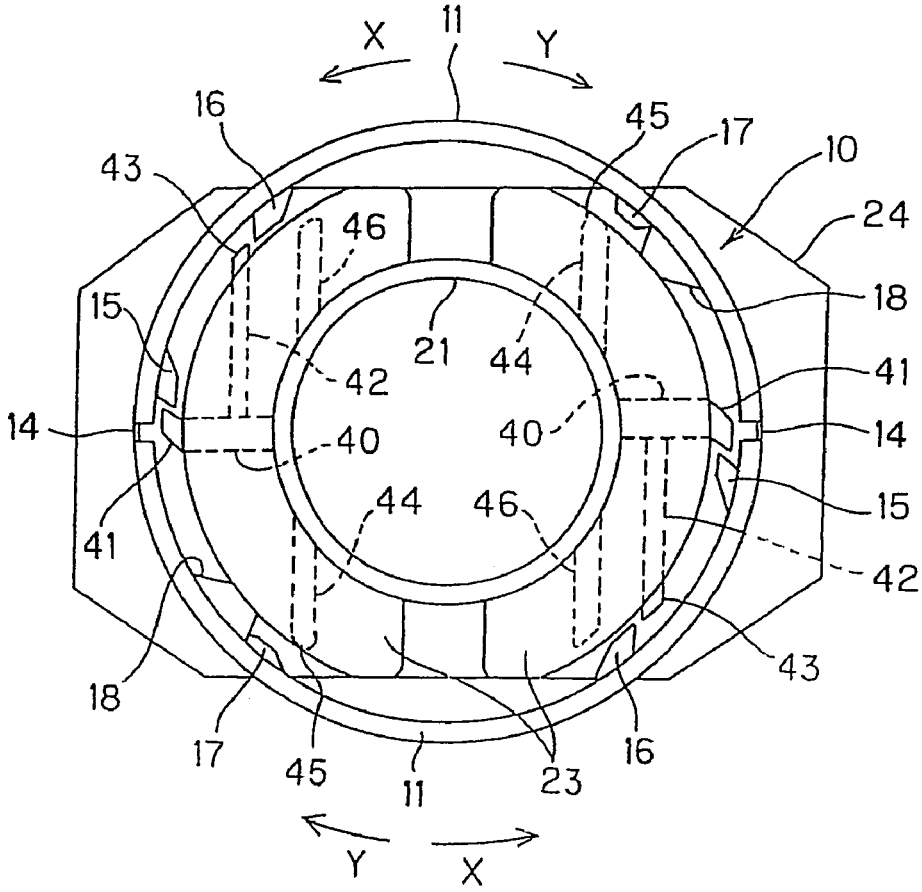
FIG. 6 is a view showing a stopper of the pouring spout, a base seat, ribs formed therebetween, ratchets formed to front ends of the ribs, and a deformation prevention portion, and showing a positional relationship thereamong.

The details of the pouring spout 20 which is to be screw-engaged with the open/close cap 2 are described hereunder with reference to FIGS. 5 and 6.

The pouring spout 20 has an upper tubular mouth portion 21 and a lower fine longer tubular straw portion 28. A plurality of layered base seats 24, 25 and 26 extending horizontally outward from the outer periphery of the pouring spout 20 are disposed between the mouth portion 21 and the straw portion 28, and a mount portion 27 to be bonded to the upper end of the container A is also disposed therebetween on the lower side of the base seats 24, 25 and 26.

The straw portion formed to the lower portion of the pouring spout 20 has a fine elongated tubular shape which is inserted inside the container A. The straw portion 28 is also formed, at its lower end, with an opening 29 and with a slot 30, at its side surface, communicating the straw portion 28. The straw portion 28 is further formed with a plate-like portion 31 so as to extend on both side directions. The plate-like portion 31 serves to ensure a passage to the opening 29 and the slot 30 at a time when the container A is crushed to thereby introduce the inner content of the container A inside the straw portion 28.

The mount portion 27 has a flat shape in the longitudinal direction and extends in the lateral direction. This mount portion 27 has an outer surface to which an upper edge of the container A is bonded together so as to be tightly sealed with no gap.

The base seats 24, 25 and 26 are arranged so as to form three-layer structure, and these base seats are each formed so as to have an octagonal shape extending laterally, and that is, extending horizontally from the outer periphery of the mouth portion. Further, the lowest base seat 26 has a lower surface abutting against the upper edge of the container A to prevent the pouring spout 20 from falling into the container A in a manufacturing process.

On the other hand, the mouth portion disposed above the pouring spout 20 has a tubular (cylindrical) structure and is formed, at its outer periphery, with a spiral male screw 22. The male screw 22 is engaged with a female screw 5 formed to the inner wall surface of the open/close cap 3 to thereby screw engage the open/close cap 3 with the mouth portion 21, whereby the open/close cap 3 is detachably mounted to the mouth portion 21.

Furthermore, a pair of sector-shaped stoppers 23 are formed to the lower end of the mouth portion 21 so as to extend laterally from the outer peripheral surface of he mouth portion 21. The outer edges of the respective stoppers 23 are positioned inside the outer peripheral edge of the base seat 24. These stoppers 23 are separated from each other at positions corresponding to the front and back surface portions of the container A so as to oppose to each other with the end surfaces thereof being parallel.

The stoppers 23 are disposed above the upper base seat 24 with a gap having a predetermined distance. In this gap, a plurality of ribs 40, 42, 44 and 46 connecting the base seat 24 and the stoppers 23 are disposed so as to extend toward the outer edges of the stoppers 23.

Among these ribs, a pair of ribs 40 are disposed so as to extend respectively laterally from the outer peripheral surface of the mouth portion 21. The front ends of the ribs 40 project radially outward from the outer edges of the stoppers 23. The front end of the rib constitutes a ratchet 41 engageable with the claw portion 15 formed to the each band piece 11 of the open/close cap 2. These ratchets 41 are arranged symmetrically with respect to the mouth portion 21 being an axis at the outer edges of the stoppers 23.

On the other hand, a pair of other ribs 42 extend, from the intermediate positions between the root and front end portions of the ribs, to the peripheral edges of the stoppers 23 at right angles with respect to the ribs 40. The front ends of these ribs 42 also project toward the outer side from the outer edges of the stoppers 23, and the projecting ends thereof also function as ratchets 43. These ratchets 43 are arranged also symmetrically with respect to the mouth portion 21 being an axis at the outer edges of the stoppers 23. Further, the ratchets 43 are inevitably inclined in the direction reverse to the opening direction X of the open/close cap 2 because the ribs 42 extend, from the intermediate positions between the root and front end portions of the ribs 40 at right angles with respect to the ribs 40.

These ratchets 41 and 43 are arranged such that when the screwed open/close cap 2 is loosened, the ratchet 41 is engaged with the claw portion 15 and the ratchet 43 is simultaneously engaged with the claw portion 16.

Two pairs of ribs 44 and 46 are disposed between the base seat 24 and the stoppers 23 so as to extend toward the outer edges of the stoppers 23 from the outer peripheral surface of the mouth portion 21. These ribs 44 and 46 are disposed each between the rib 40 provided with the ratchet 41 and the end surface positioned in the cap opening direction X with respect to the rib 40 and between the rib 40 and the end surface positioned in the cap closing direction Y for fastening the open/close cap 2. The front ends of the paired ribs 44 and the front ends of the paired ribs 46 are symmetrically arranged respectively with the mouth portion 21 being interposed therebetween.

Among these ribs, the ribs 44 positioned on the end surface side in the cap opening direction X projects, at its tip end surface, slightly outward of the outer edge of the stopper 23, and on the other hand, the rib 46 is positioned between the rib 40 and the end surface in the cap opening direction X, at its tip end surface, inside the outer peripheral edge of the stopper 23 by a predetermined distance. When the band pieces 11 are pushed by hands radially inward, the protruded portions 17 and 18 abut against the tip end surface of the rib 44, which hence acts as the deformation preventing portion 45 for preventing the band pieces 11 from being deformed. The deformation preventing portion 45 may be disposed to be flash with the outer edge of the stopper 23. The positional relationship in the circumferential direction in which the deformation preventing portion 45 as the front end of the rib 44 tip end corresponds to the position just before the ratchet 41 and the claw portion 15 is engaged, the ratchet 43 and the claw portion 16 is engaged, and the connection pieces are then cut off, at the time when the open/close cap 2 is loosened. When the open/close cap 2 is rotated to the position just before the connection pieces 14 are cut off, the protruded portions 17 and 18 are positioned to the portions corresponding to the deformation preventing portion 45.

According to the open/close cap 2 having the structure mentioned hereinabove, the band 10 can be protected from cutting off in the following manner in a state that the open/close cap 2 is tightly sealed to the mouth portion 21.

Figure 7:
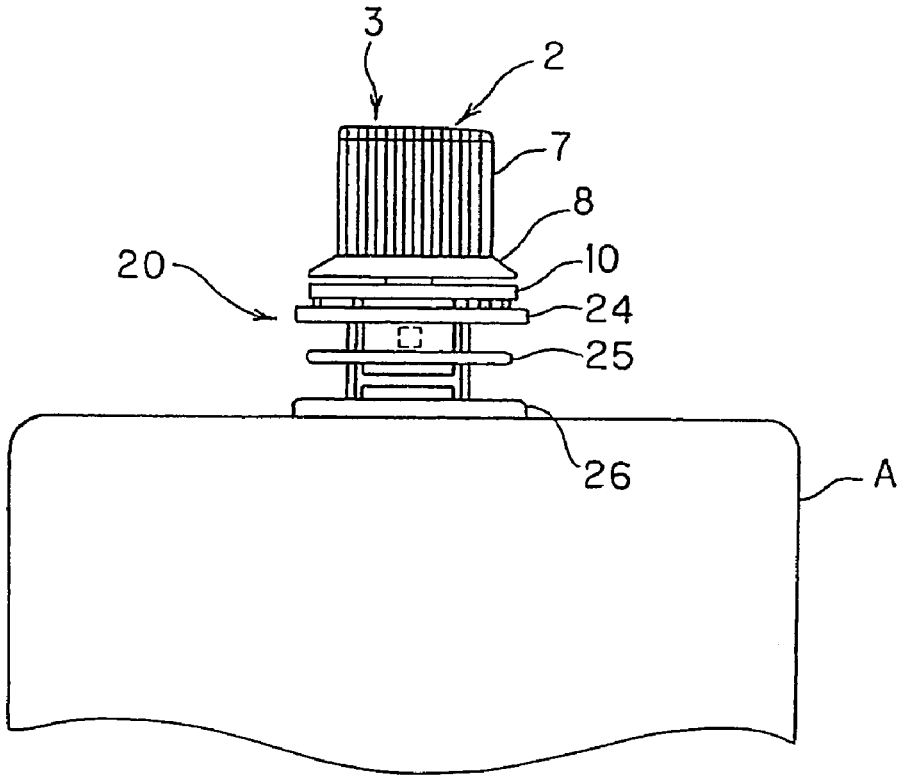
FIG. 7 is a front view of a container showing a condition that the open/close cap seals the mouth portion of the pouring spout.

As shown in FIG. 7, when the mouth portion 21 of the pouring spout 20 is tightly sealed by the open/close cap 2, the band 10 is positioned between the upper base seat 24 and the contact preventing portion 8. The peripheral edge of the base seat 24 extends radially outward over the outer peripheral surface of the band, and on the other hand, the outer peripheral edge of the contact preventing portion 8 extends radially to the position substantially the same as the outer peripheral edge of the band 10. For this reason, the band 10 disposed between the upper base seat 24 and the contact preventing portion 8 hardly contact an external foreign material, and hence, the application of an external force to the band 10 can be effectively prevented.

In addition, the coupling pieces 12 and 13 connect, at the inner surface side, the lower end surface of the cap body 3 and the band 10, so that the coupling pieces 12 and 13 are protected by the contact preventing portion 8 and the band 10 itself to thereby surely be prevented from contacting the external foreign material. For this reason, in the state that the open/close cap 2 is fastened to the pouring spout 20 to seal the mouth portion 21, the coupling pieces 12 and 13 never be cut off by the mere contact of the cap 2 to the external foreign material, and the tampering preventing function can be effectively achieved.

Further, in the state that the cap 2 closes the mouth portion 21, as shown in FIG. 6, the connection pieces 14, 14 connecting the band pieces 11, 11 are positioned near the central portion in the circumferential direction of the outer edge of the stoppers 23. The ratchet 41 and the claw portion 15 and the ratchet 43 and the claw portion 16 are opposed to each other with small gaps, respectively. In addition, with the deformation preventing portion 45 formed to the front end of the rib 44 and the protruded portions 17 and 18 formed to the band pieces 11, slight gaps are formed therebetween in the circumferential thereof and the protruded portions 17 and 18 are positioned at the rear side in the cap opening direction X. As mentioned, by forming a plurality of ratchets 41 and 43 to the pouring spout 20 and disposing the claw portions 15 and 16 to be engaged therewith to the band 10 of the open/close cap 2, a play can be prevented from causing in the cap rotating direction. In addition, when the cap 2 closes the mouth portion 21, substantially no gap is formed between the ratchet 41 and the claw portion 15 and between the ratchet 43 and the claw portion 16, which also prevents the formation of a play in the rotating direction of the cap 2.

Incidentally, the tampering preventing function will be achieved in the following manner.

The outer edge of the base seat 24 disposed below the stoppers 23 largely extends laterally. The outer edge of the base seat 24 extends outward the outer peripheral surface of the respective band pieces 11 at the position disposed to the band pieces 11 in a range between the deformation preventing portion 45 positioned at the foremost portion in the opening direction X of the open/close cap 2 and the claw portion 16 positioned at the rearmost portion in the cap opening direction X. For this reason, at the portions at which the ratchets 41, 43, the claw portions 15, 16, the deformation preventing portion 45 and the protruded portions 17, 18 are positioned, no space for invading a material inside the open/close cap 2 is formed between the band pieces 11 and the base seat 24, so that the ratchets 41, 43 and the claw portions 15, 16 are hidden by the base seat 24 and the band pieces 11, thereby effectively preventing an intentional work from the outside to the ratchets 41, 43 to open the cap 2 from being done.

Furthermore, the pouring spout 20 is provided with a plurality of ratchets 41 and 43, and on the other hand, the band pieces 11 of the open/close cap 2 are provided with a plurality of claw portions 15 and 16 to be engageable with the ratchets 41 and 43. For this reason, in order to rotate the cap 2 without damaging the band pieces 11, the coupling pieces 12, 13 and the connection pieces 14, it is required to simultaneously work all the ratchets 41, 43 and the claw portions 15, 16 to be engaged therewith. However, it is extremely difficult to simultaneously work these ratchets 41, 43 and the claw portions 15, 16, which are hidden by the band pieces 11 and the base seat 24. Thus, by forming a plurality of ratchets 41, 43 and the claw portions 15, 16, the tampering preventing function can also be achieved.

Hereunder, with reference to FIGS. 8 to 10, the function and operation of the cap opening process will be described.

First, the open/close cap 2 is rotated in the cap opening direction X, i.e., counter-clockwise direction with respect to the pouring spout 20. Then, as shown in FIG. 8, the ratchet 41 is engaged with the claw portion 15, and the ratchet 43 is engaged with the claw portion 16. When the open/close cap 2 is further rotated, from this state, in the cap opening direction X, the ratchets 41, 43 and the claw portions 15, 16 are deeply engaged together. In this instance, circumferential tension is applied to the band 10 and the connection pieces 14 are hence cut off. That is, when the claw portions 15, 16 of the band pieces 11 are engaged with the ratchets 41, 43, respectively, the portion in the predetermined range of the band pieces 11 positioned on the rear side of the cap opening direction X is prevented from rotating with the connection pieces 14 being the reference position, and on the other hand, the portion in the predetermined range of the band pieces 11 on the front side in the cap opening direction X is rotated. Accordingly, pulling force is applied to the connection pieces 14, and as shown in FIG. 9, they are cut off so as to be separated in the circumferential direction.

Furthermore, the respective band pieces 11 deform with the front portion in the cap opening direction X being directed downward. Among the coupling pieces 12 and 13 coupling the band pieces 11 and the cap body 3, the coupling piece 13 positioned on the rear side in the cap opening direction X maintains the coupled condition, without being cut off, between the band pieces 11 and the cap body 3. On the other hand, the coupling piece 12 positioned on the front side and having thin thickness and narrow width is applied with a tensioning load and is then cut off.

When the open/close cap 2 is further rotated in the cap opening direction X, and the protruded portions 17 and 18 for deformation reach the position of the ratchet 43, the protruded portions 17 and 18 ride over the ratchet 43. At this instance, the band pieces 11 are further applied with the twisting force, and therefore, as shown in FIG. 10, the respective band pieces 11, 11 deform largely downward at their front sides in the cap opening direction X. As mentioned, the deformation of the band pieces 11 of the open/close cap 2 makes extremely easy the confirmation of the open/close cap 2 in the condition after being opened.

Figure 10:
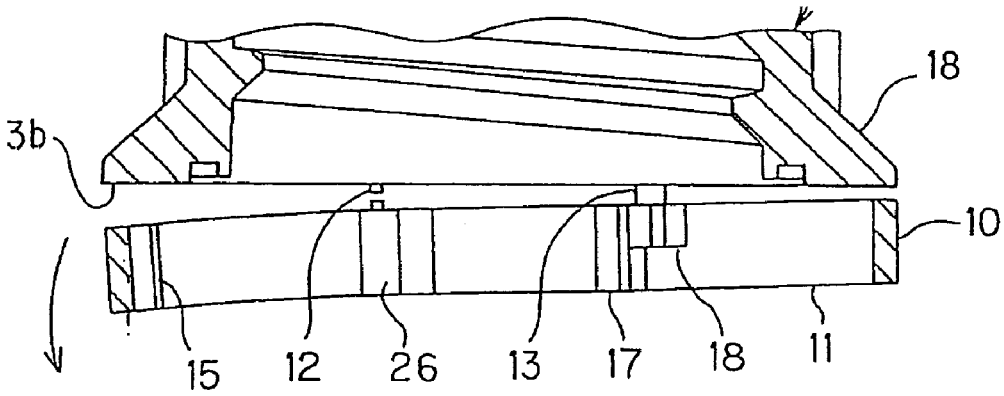
FIG. 10 is a view showing a cut-off condition of the coupling piece.
Figure 11:
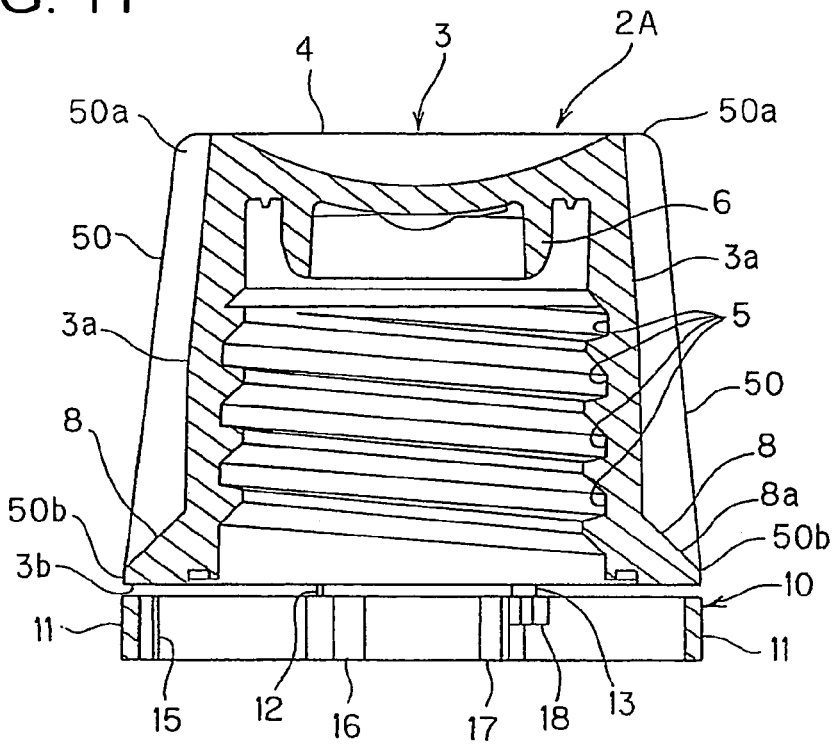
FIG. 11 is an elevational section of an open/close cap according to another embodiment of the present invention.

Further, the open/close cap may be formed as shown in FIG. 11. The open/close cap 2A shown in FIG. 11 differs from the open/close cap 2 in the structure of a rib 50 formed on the outer peripheral surface of the cap body 3, and the other structures are substantially the same as those shown in FIGS. 1 to 10. Accordingly, the same reference numerals are added to the corresponding portions and the detailed explanations thereof are omitted herein.

The open/close cap 2A is also composed of the cap body 3 and the band 10 coupled to the lower end surface 36 of the cap body 3. The cap body 3 has a tubular structure having a closed upper surface 4 and opened bottom portion. A spiral female screw 5 is formed to the inner surface of the tubular cap body 3 so as to be screwed to an outer peripheral surface of the mouth portion of the pouring spout, not shown. A cylindrical seal member 6 is formed to an inner surface of the upper portion 4 of the cap body 3 radially inward from the inner wall surface thereof.

To the lower portion of the cap body 3, is formed a contact preventing portion 8. The contact preventing portion 8 is formed by extending the lower portion of the cap body 3 radially outward, and the outer surface 8*a* thereof is inclined downward in the radial outward direction so as to provide a shade.

Furthermore, a plurality of ribs 50 are formed to the outer peripheral surface 3*a* of the cap body 3 so as to project radially outward therefrom in the circumferential direction. The rib 50 has an upper end 50*a* flush with the upper surface 4 of the cap body 3 and a lower end 50*b* also flush with the lower end surface 3*a* of the cap body 3. For such arrangement, in this cap 2, the contact preventing portion 8 is not extended over the rib 50, and the rib 50 covers the outer peripheral surface of the contact preventing portion 8, and hence, the ribs 50 are also function as the contact preventing portion.

Incidentally, the band 10 is positioned below the lower surface of the cap body 3. The band 10 is divided into two band pieces 11, 11 in the circumferential direction thereof, and these band pieces 11 connected through the connection pieces 14, 14 at their circumferential end portions. The band 10 is connected to the cap body 3 by coupling the band pieces 11 to the lower end surface 3*b* of the cap body at two portions by means of coupling pieces 12 and 13. These coupling pieces 12 and 13 are disposed on the inner peripheral side of the respective band pieces 11, 11.

Figure 12:
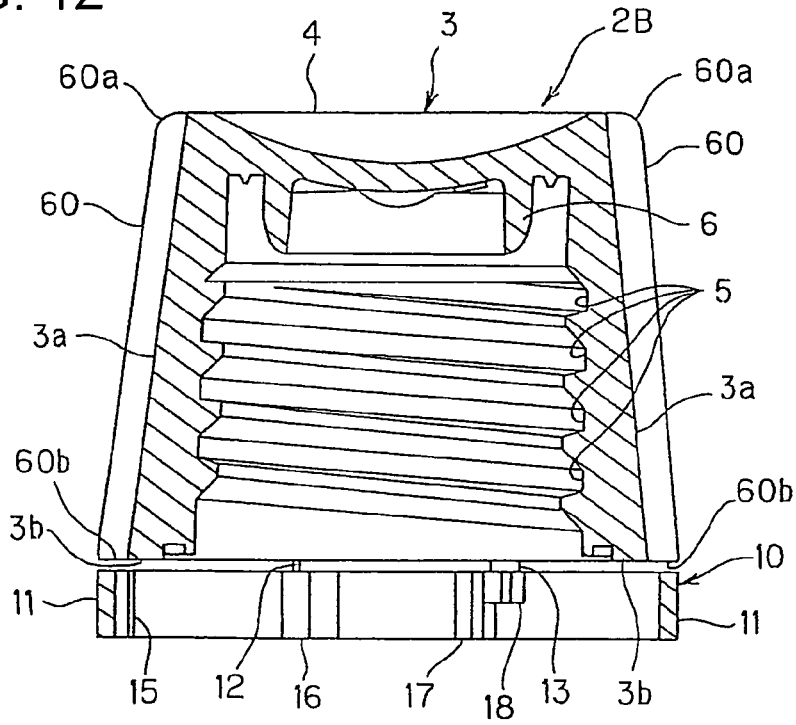
FIG. 12 is an elevational section of an open/close cap according to a further embodiment of the present invention.

FIG. 12 shows an open/close cap according to a further embodiment of the present invention.

An open/close cap 2B of this embodiment is also composed of the cap body 3 and the band 10 coupled to the lower end surface 3*b* thereof. The cap body 3 has a tubular structure having a closed upper surface 4 and opened bottom portion. A spiral female screw 5 is formed to the inner surface of the tubular cap body 3. A cylindrical seal member 6 is formed to an inner surface of the upper portion 4 of the cap body 3 so as to extend downward.

In the open/close cap 2B of this embodiment, the outer peripheral surface 3*a* of the cap body 3 is broadened toward the lower end so as to entirely show a circular truncated conical shape. Furthermore, a plurality of ribs 60 are formed to the outer peripheral surface 3*a* of the cap body 3 so as to project radially outward therefrom in the circumferential direction. The rib 60 has an upper end 60*a* flush with the upper surface 4 of the cap body 3 and a lower end 60*b* also flush with the lower end surface 3*a* of the cap body 3.

On the other hand, the band 10 is positioned below the lower surface 3*b* of the cap body 3. The band 10 is divided into two band pieces 11, 11 in the circumferential direction thereof, and these band pieces 11 are connected through the connection pieces 14, 14 at their circumferential end portions. On the other hand, the band 10 is connected to the cap body 3 by coupling the band pieces 11 to the lower end surface 3*b* of the cap body at two portions by means of coupling pieces 12 and 13. These coupling pieces 12 and 13 are disposed on the inner peripheral side of the respective band pieces 11, 11.

In this open/close cap 2B, the front (downward) ends of the ribs 60 extend, at the lower portion of the cap body 3, to the position substantially the same as the outer peripheral surface of the band 10. Because of this reason, in this open/close cap 2B, the ribs 60 function themselves as the contact preventing portion.

In the above, the structure in which the band is coupled to the lower end of the cap body is described, but the present invention is not limited to this structure, and for example, there may take a structure in which the coupling pieces extend from the inner peripheral surface of the cap body or extend from the outer peripheral surface thereof so as to be coupled to the band 10. Furthermore, the band is not limited to two divided pieces, and the band may have at least only one portion at which the band is divided in the circumferential direction, or may be divided into three or more band pieces.

On the other hand, as to the contact preventing portion, although the example extending to the position substantially the same as the outer peripheral surface of the band in the radial direction is described, the present invention is not limited to such example, and an example in which it extends radially outward from the outer peripheral surface from the band may be adopted.

Next, an embodiment in which a deformation prevention means is provided for preventing the deformation of the band will be explained even in a case when a radially inward force is applied to the band. Further, the basic structure of an open/close cap of such embodiment is substantially the same as that of the above embodiment, so that the same reference numerals are added to the corresponding portions and the detailed explanations thereof will be hence omitted herein.

Figure 13:
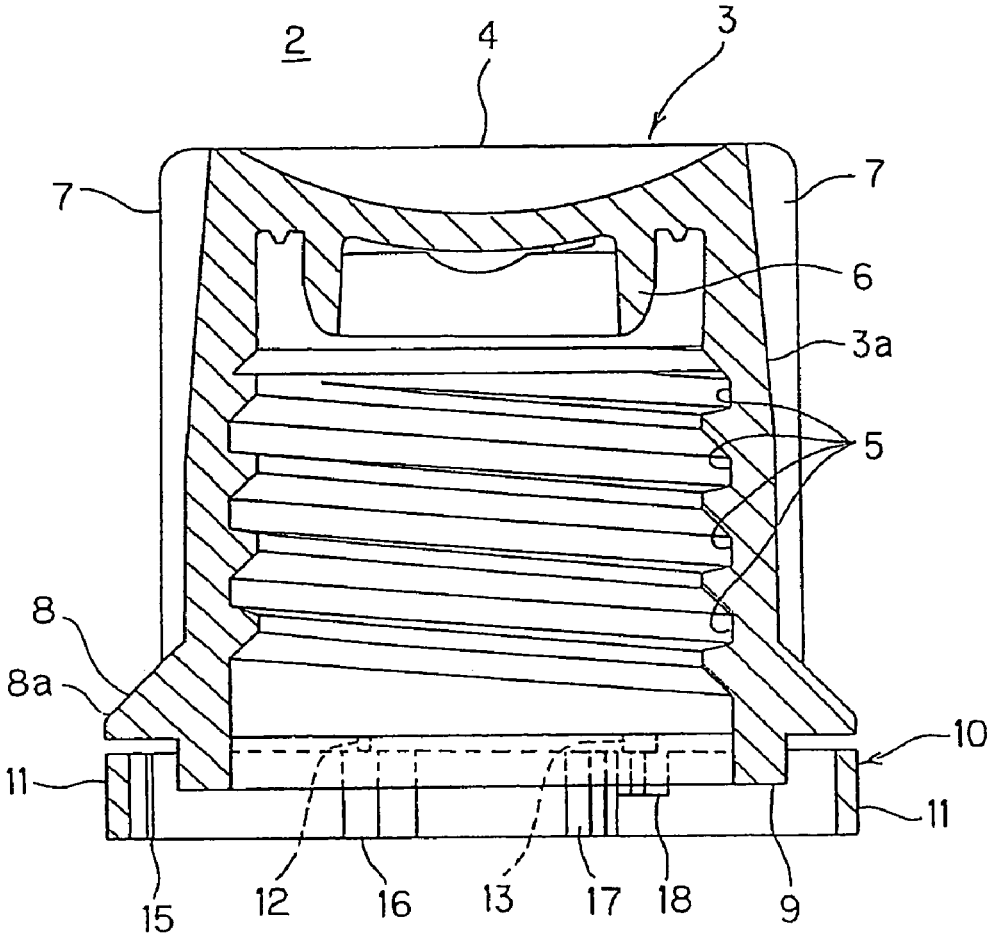
FIG. 13 is an elevational section of an open/close cap provided with a band-shape maintaining portion.

FIG. 13 shows the structure of the open/close cap 2.

This open/close cap 2 is composed of a tubular cap body 3 and a band 10 provided to the lower end of the cap body 3 so as to extend in the circumferential direction of the cap 2.

The cap body 3 is composed of a tubular member having an upper surface closed and a lower portion opened. A spiral female screw 5 is formed to the inner surface of the cap body 3 so as to be engaged with the outer peripheral surface of the mouth portion 21. A cylindrical seal member 6 is formed to the inner surface of the upper portion of the cap body 3 so as to project downward at the radially inside portion from the inner wall surface of the cap body. The seal member 6 prevents the inner content from leaking outward at the time when the open/close cap 2 is screw-engaged with the mouth portion 21 by tightly contacting the outer peripheral surface of the cap to the inner surface of the mouth portion 21. Further, ribs 7 radially projecting in the radially outward direction are formed to the outer peripheral surface 3*a* of the cap body 3 in the entire circumferential direction thereof.

Furthermore, the contact preventing portion 8 is formed to the lower portion of the cap body 3 by extending the lower portion of the cap body 3 radially outward. The outer surface 8*a* of this contact preventing portion 8 serves to prevent a foreign material such as another open/close cap from colliding against the band 10.

On the other hand, the band 10 is disposed below the lower end surface 3*b* of the cap body 3 and is coupled to the lower end surface 3*b* through the coupling pieces 12 and 13, respectively. The band 10 is divided into two pieces in its circumferential direction, and these band pieces are connected together at their circumferential ends by means of connection pieces 14. The band 10 is coupled to the open/close cap 2 in the manner that the band pieces 11, 11 are coupled to the lower end surfaces 3*b* of the cap body 3 at circumferential two portions through the coupling pieces 12 and 13, respectively. These coupling pieces 12 and 13 are disposed on the inner peripheral side of the band pieces 11, 11.

Furthermore, two claw portions 15 and 16 are formed at two portions on the inner peripheral surface of the band pieces 11. In addition, two trapezoidal protruded portions 17 and 18 are formed to the respective band pieces 11 so as to be overlapped with each other. These protruded portions 17 and 18 project in the radial direction toward the center axis of the open/close cap 2 from the inner surface of the band pieces 11.

In addition to the above structure, the cap body 3 is integrally formed with a band shape maintaining member 9 projecting downward from the lower end surface of the cap body 3. This band shape maintaining member 9 serves to prevent the band 10 from being pushed radially inward of the open/close cap 2 even if another open/close cap 2 abuts against the band. The band shape maintaining member 9 has an annular shape having an outer diameter of a size or dimension such that a predetermined gap is formed between it and the inner surface of the band 10. That is, the outer diameter of the band shape maintaining member 9 is determined such that, in a normal state, the claw portions 15, 16 and the protruded portions 17, 18 formed to the inner surfaces of the band pieces 11, 11 do not interfere with this band shape maintaining member 9. On the other hand, the inner diameter thereof is made to be equal to the inner diameter of the cap body 3. Furthermore, as shown in FIG. 13, the band shape maintaining member 9 projects so that the lower end thereof accords with substantially the central portion of the band 10 in its height direction.

Figure 14:
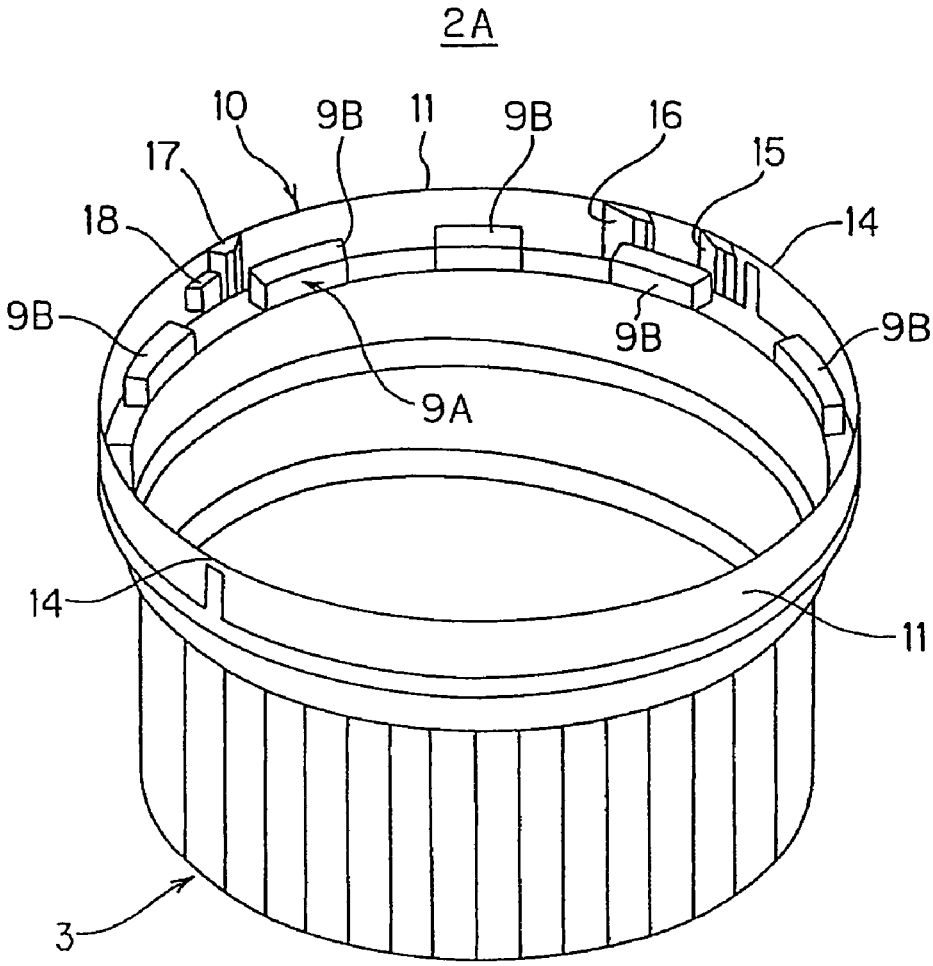
FIG. 14 is a perspective view as seen from a back side of the open/close cap according to a further embodiment different from the open/close cap of FIG. 13.

The band shape maintaining member 9 may be disposed as shown in FIG. 14. Further, the structure of the open/close cap 2A shown in FIG. 14 is substantially the same as the cap 2 shown in FIG. 13 except the band shape maintaining member 9A.

In the open/close cap 2A shown in FIG. 14, a plurality of projections 9B are intermittently disposed, in the circumferential direction, inside the band 10 at the lower end surface of the cap body 3, thus constituting the band shape maintaining member 9A. These projections 9B are disposed evenly in the circumferential direction of the open/close cap 2A. Each projection 9B has a height approximately ½ to ⅓ of the height of the band 10. In the formation of such band shape maintaining member 9A, the band 10 can be effectively prevented from being pushed radially inward.

Figure 15:
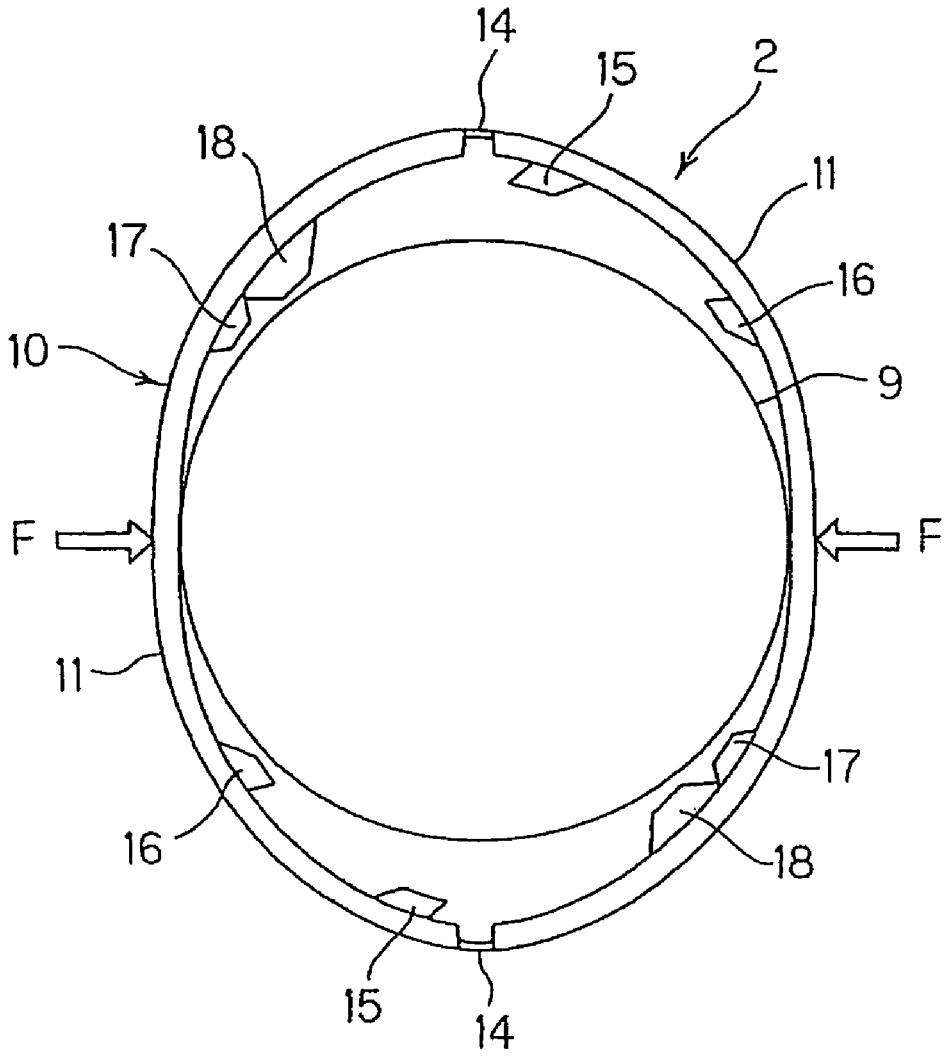
FIG. 15 is a view explaining a condition in which an external force for deforming the band radially inward of the open/close cap acts.

FIG. 15 is a view for explaining the function of the band shape maintaining member 9 and shows a case in which, in a state that the open/close cap 2 exists solely without being fastened by the pouring spout 20, an external force for deforming the band 10 radially inward from the outer side of the cap 2 is applied.

Figure 20:
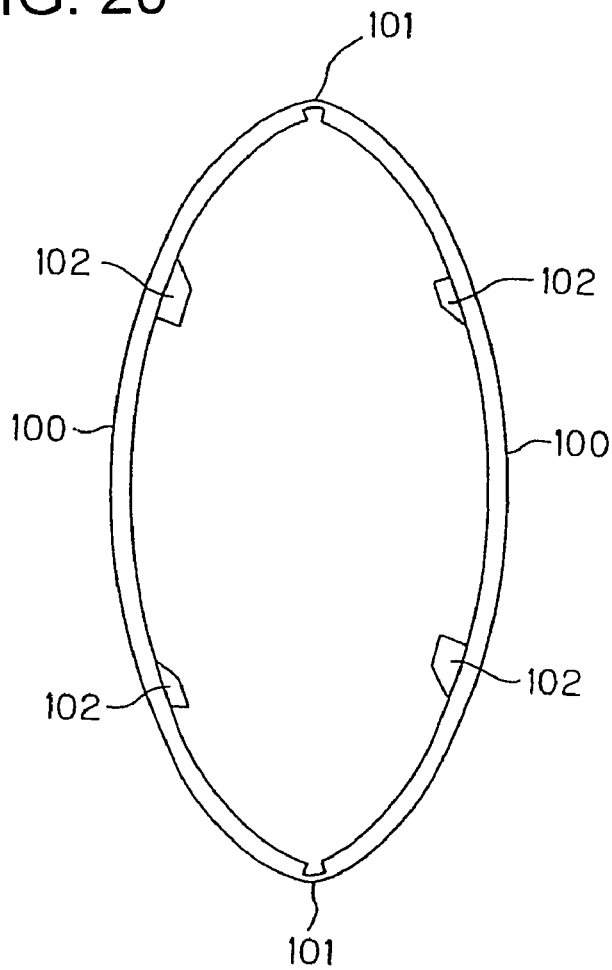
FIG. 20 is a view showing a condition of a deformed band when an external force is applied to a band of a conventional open/close cap.

When such external force is applied to the band 10, in a conventional product shown in FIG. 20, a point on which the external force is applied is largely pushed into the radially inside. Then, a large stress is caused to the connection pieces connecting the band pieces, and in a worst case, the connection pieces may be cut off. On the contrary, according to the open/close cap 2 of the present embodiment provided with the band shape maintaining member 9, even if the external force is applied to the band 10, the respective band pieces 11 abut against the outer peripheral surface of the band shape maintaining member 9. Accordingly, the point on which the external force is applied is not pushed further more radially inward. Thus, the deformation of the band can be suppressed to be constantly small. With the deformation of the degree such as shown in FIG. 15, much stress is not caused to the connection pieces 14 connecting the band pieces 11 together, and the cut-off of the connection pieces 14 can be effectively prevented.

Figure 16:
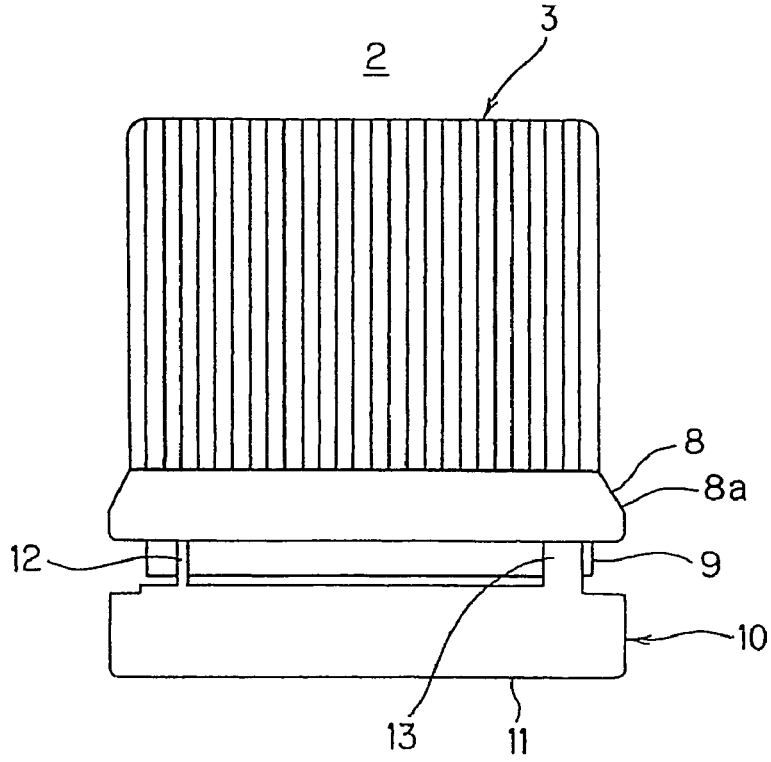
FIG. 16 is a view explaining a method of manufacturing the open/close cap by simultaneously injection-molding the cap body and the band and then pushing the band inside the cap body.
Figure 16:
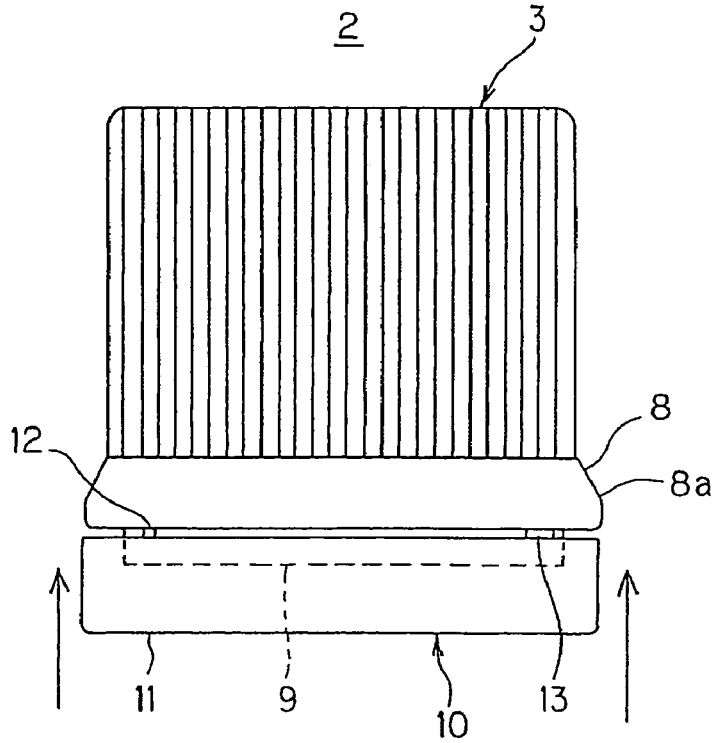

FIG. 16 shows one step for manufacturing the open/close cap 2.

The open/close cap 2 is manufactured integrally by an injection molding process. That is, a mold is provided with cavities for forming the band pieces 11 forming the band 10, the coupling pieces for coupling the cap body 3 to the band pieces 11, the connection pieces for connecting the respective band pieces 11 to each other and the band shape maintaining member 9 for preventing the deformation of the band 10. Resin material is injected to fill these cavities and the respective portions or pieces are then molded through one injection shot.

FIG. 16(*a*) shows the state just after the injection molding. As shown in FIG. 16(*a*), in the injection molding process, the band 10 is formed with a predetermined distance from the lower end of the cap body 3 and is connected thereto through the coupling pieces 12 and 13. In this injection molding process, the dimension between the lower end of the cap body 3 and the upper end of the band 10 is slightly larger than a dimension between the lower end of the cap body 3 and the lower end of the band shape maintaining member 9. After the injection molding, the band 10 is instantaneously pushed toward the cap body 3. Accordingly, as shown in FIG. 16(*b*), the coupling pieces 12 and 13 are contracted so that the upper end of the band 10 approaches the lower end of the cap body 3, and the gap therebetween becomes very small. At this time, the band 10 is fully pushed inside so that the lower end of the band 10 does not interfere with the pouring spout 20 at a time when the cap body 3 is fastened to the pouring spout 20.

Further, it is to be noted that the cap manufacturing method is not limited to the method represented by FIG. 16.

Figure 17:
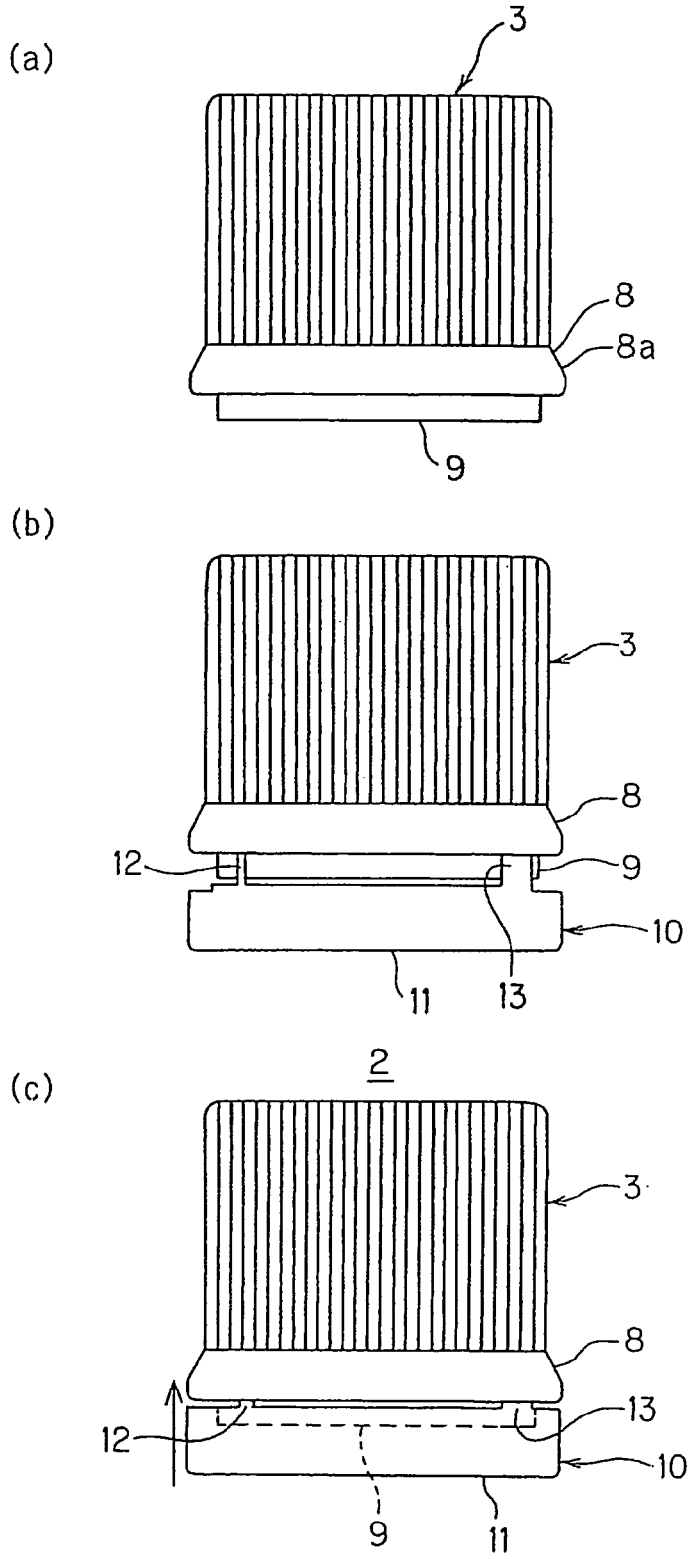
FIG. 17 is a view explaining another method of manufacturing the open/close cap different from the method of FIG. 16.

According to the method mentioned above, the cap body 3 and the band 10 are formed through one injection shot to thereby provide the state shown in FIG. 16(*a*). As shown in FIG. 17, however, the cap body 3 and the band 10 may be formed independently by using one injection molding machine. That is, in the method shown in FIG. 17, in the first step, only the cap body 3 is injection molded (FIG. 17(*a*)), and then, in the second step, the band 10 is injection molded (FIG. 17(*b*)). In such case, the cap body 3 and the band 10 are disposed such that a gap between the upper end of the band 10 and the lower end of the cap body 3 is larger than a distance between the lower end of the cap body 3 and the lower end of the band shape maintaining member 9. Thereafter, the band 10 is pushed toward the cap body 3 and the coupling pieces 12 and 13 are contracted so that the band 10 is positioned outside the band shape maintaining member 9 (FIG. 17(*c*)).

Figure 18:
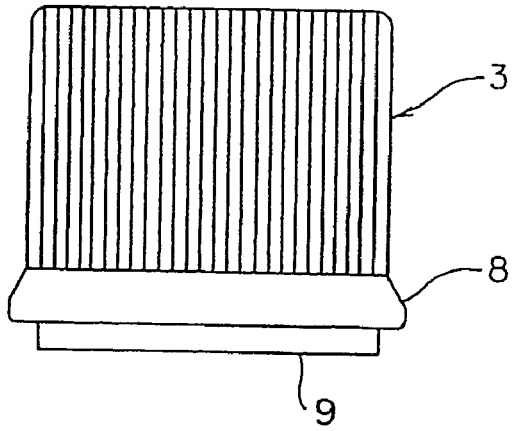
FIG. 18 is a view explaining a further method of manufacturing the open/close cap different from the method of FIG. 16.
Figure 18:
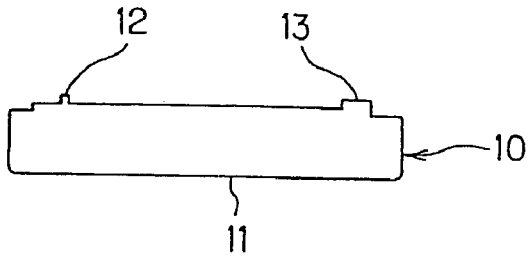
Figure 18:
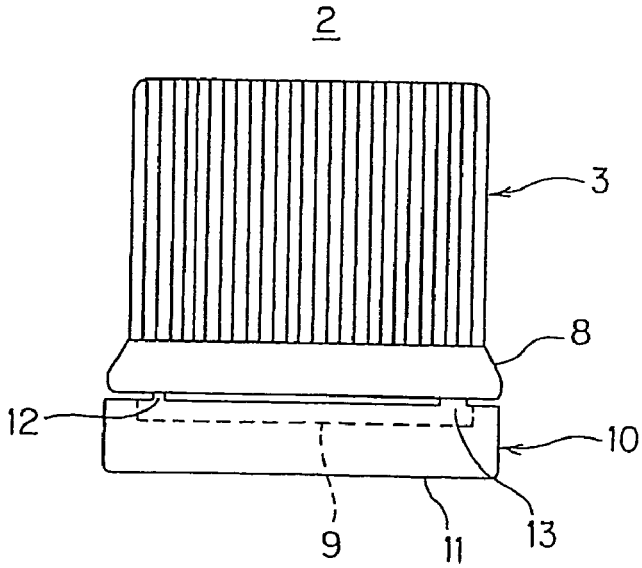

Furthermore, as shown in FIG. 18, it may be possible to independently mold the cap body 3 and the band 10, and then, they are coupled together. That is, as shown in FIG. 18(*a*), the cap body 3 is molded by using one injection molding machine, and the band 10 is molded by using another injection molding machine as shown in FIG. 18(*b*). In such case, the coupling pieces 12 and 13 are molded to either one of the lower end portion of the cap body 3 or upper end portion of the band 10. In the embodiment shown in FIG. 18, the coupling pieces 12 and 13 are molded. After the injection molding of both the cap body 3 and the band 10, as shown in FIG. 18(*c*), the band 10 is coupled to the lower end of the cap body 3. In this coupling step, the band 10 is preliminarily pushed into the cap body 3 so that the band 10 is positioned outside the band shape maintaining member 9. After this pushing, the cap body 3 and the band 10 are fused and coupled at the positions of the coupling pieces 12 and 13 by means of ultrasonic seal. In the manufacture of the open/close cap 2 in this method, only by positioning the band 10 to the lower portion of the cap body 3, the coupling pieces are preliminarily formed to be short so that the band 10 is disposed to the same position as the band shape maintaining member 9 in the vertical direction.

Further, the open/close cap 2 may be manufactured by f forging technology using a fabricated material having a shape similar to that of the cap 2. That is, a fabricated material having a shape similar to that of the open/close cap 2 is injection molded. This fabricated material includes a portion from which the cap body 3 is formed and a portion from which the band 10 is formed. Such fabricated material is mechanically worked or laser-worked to provide the cap body 3 and the band 10 which are coupled by means of coupling pieces 12 and 13.

The manufacturing method of the open/close cap 2 will be preferably selected from those mentioned above in consideration of equipments or like owned by a user.

Figure 8:
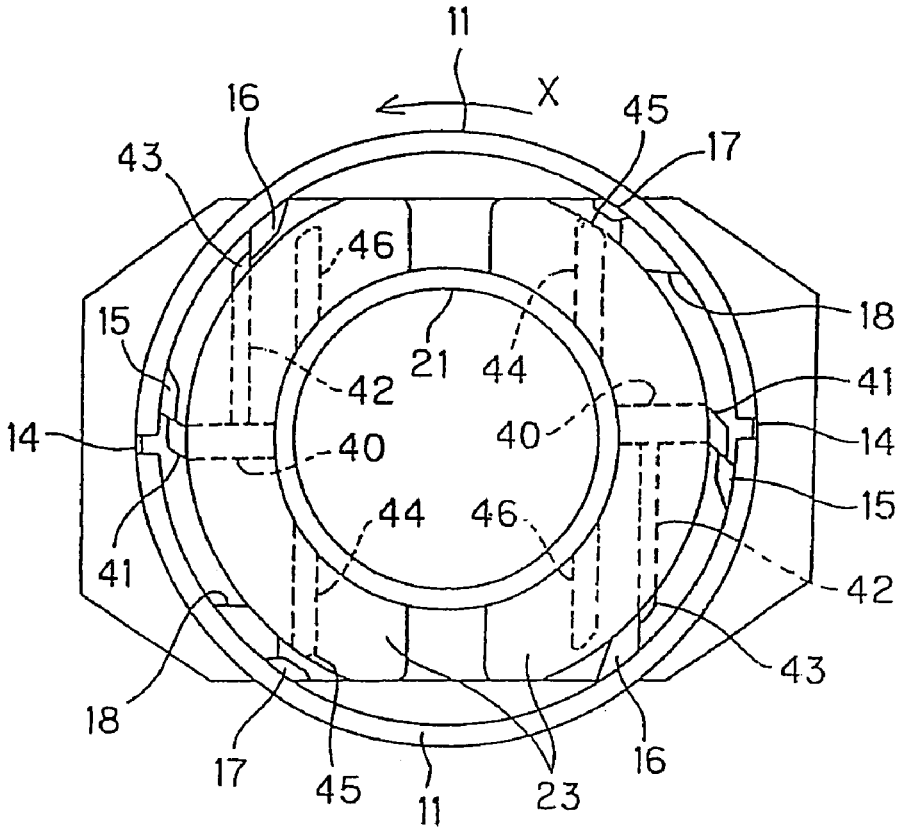
FIG. 8 is a view showing a condition that the ratchet abuts against the claw portion.
Figure 9:
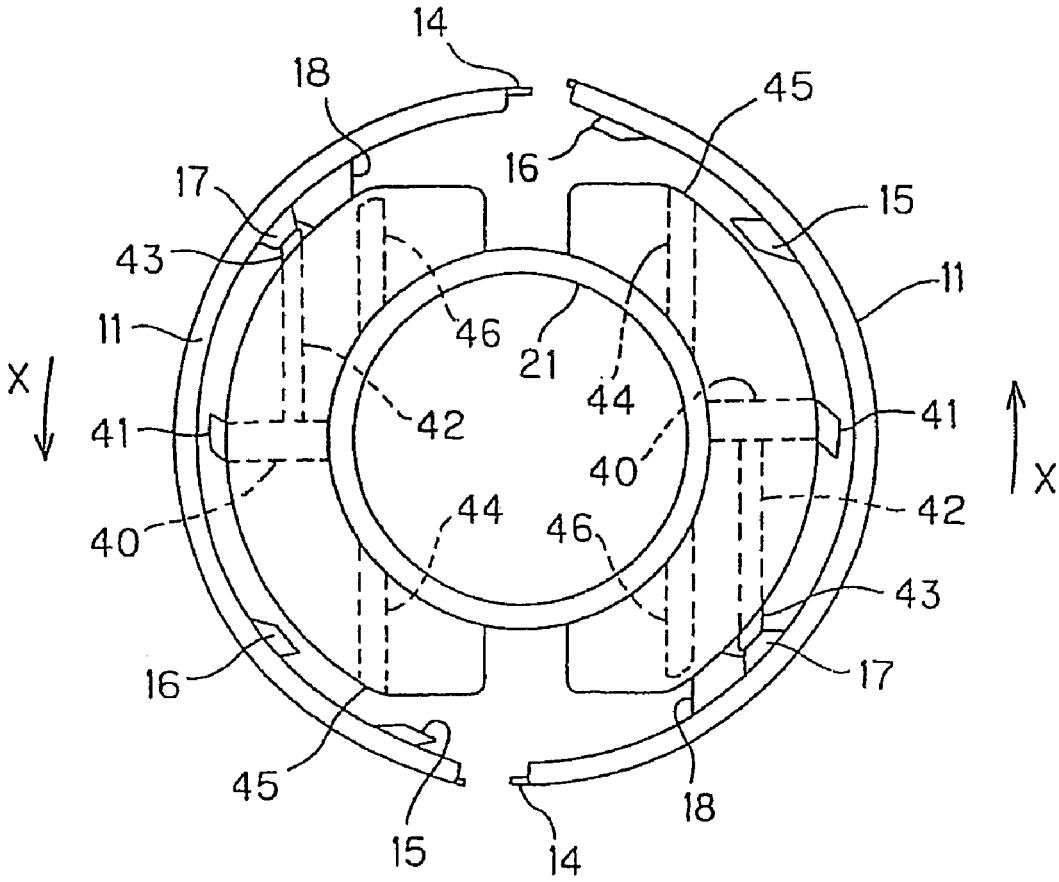
FIG. 9 is a view showing a cut-off condition of the connection piece.

This open/close cap 2 is also opened from the pouring spout 20 through the operations mentioned with reference to FIGS. 8 and 9.

That is, at first, the open/close cap 2 is rotated in the cap opening direction X, being the counter-clockwise direction, with respect to the pouring spout 20. Then, as shown in FIG. 8, the ratchet 41 and the claw portion 15, and the ratchet 43 and the claw portion 16 are engaged with each other, respectively. From this state, when the open/close cap 2 is further rotated in the cap opening direction X, the claw portions 15, 16 are firmly engaged further with the ratchets 41, 43, respectively. At this moment, the circumferential pulling force is applied to the band 10, and the connection pieces 14 are then cut off. That is, when the claw portions 15, 16 of the band pieces 11, 11 are engaged with the ratchets 41, 43, respectively, the portions in the predetermined ranges of the band pieces 11, 11 positioned on the rear side in the cap opening direction X are prevented from rotating with reference to the connection pieces 14, 14, and on the other hand, the portions in the predetermined ranges thereof positioned on the front side in the cap opening direction X are rotated. Because of this reason, the pulling force is applied to the connection pieces 14, and as shown in FIG. 9, the connection pieces 14 are cut off and separated in the circumferential direction.

Furthermore, the respective band pieces 11 are deformed downward in their front side portions in the cap opening direction X. Among the coupling pieces 12 and 13 coupling the band pieces 11 and the cap body 3, the coupling piece 13 positioned on the rear side in the opening direction X maintains the coupling, without being cut off, between the band piece 11 and the cap body 3, and on the other hand, the coupling piece 12, having the thin thickness and narrow width, positioned on the front side in the opening direction X is applied with the pulling load, and hence, cut off.

Figure 19:
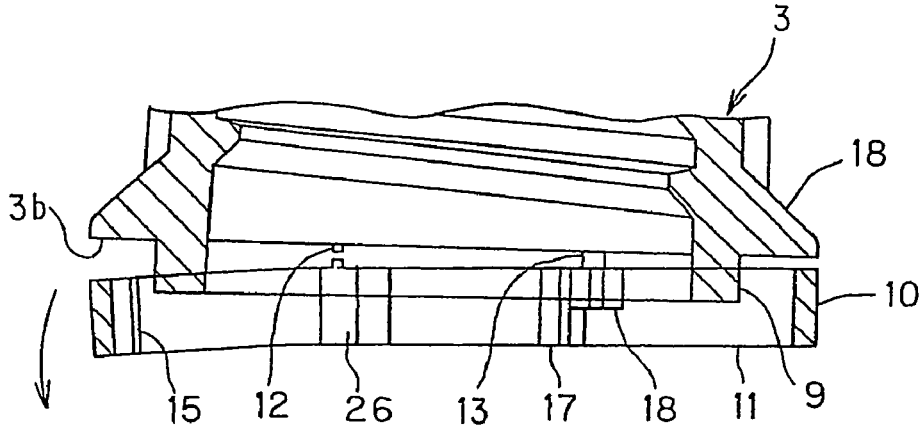
FIG. 19 is a view showing a condition after the coupling piece is cut off and the cap is opened.

Still furthermore, when the open/close cap 2 is further rotated in the opening direction X, and the protruded portions 17 and 18 for deformation reach the position of the ratchet 43, the protruded portions 17 and 18 ride over the ratchet 43. At this time, further twisting force acts to the band pieces 11. Thus, as shown in FIG. 19, the respective band pieces 11, 11 are deformed toward downward at their front side portions in the cap opening direction X. Further, in FIG. 15, a portion hidden by the band shape maintaining portion 9 is shown with solid line for the sake of easy appearance.

As mentioned above, by deforming the band pieces 11 of the open/close cap 2, the state after the open/close cap is released can be extremely easily confirmed.

The invention claimed is:

1. An open/close cap which is screwed to a mouth portion of a pouring spout of a packaging container and adapted to open the mouth portion, the open/close cap comprising:

a cap body screwed to an outer peripheral surface of the mouth portion;

a band attached to the cap body so as to extend in a circumferential direction thereof so as to be engaged with the pouring spout;

a contact preventing portion provided for the outer peripheral surface of the cap body so as to extend outward from the outer peripheral surface thereof, the contact preventing portion having a shape inclining downward so that an extending lower end portion thereof has a diameter equal to at least an outer surface of the band for preventing an application of an external force to the band; and a band shape maintaining member integrally formed on the cap body and projecting downward from a lower end surface of the cap body, the band shape maintaining member positioned to prevent the band from being pushed radially inward of the open/close cap, the band shape maintaining member with an outermost diameter defining a predetermined gap between the band shape maintaining member and an inner surface of the band, wherein, the band is provided with at least one portion for separating the band in the circumferential direction, end portions of the separated band are connected to each other by a connection piece, which connection piece is to be cut off, at that one portion, a protruded portion is formed to an inside of the band so as to project toward the pouring spout, when the open/close cap is rotated in an opening direction with respect to the pouring spout, a forward side of the band between which the connection piece is snapped when rotated together with the cap body and a rear side of the band is prevented from rotating by engagement of the protruded portion with a portion of the pouring spout, the connection piece is cut off in the circumferential direction thereof by a stress of the band generated by the engagement, and the band is positioned below the lower surface of the cap body so as to be attached to the lower portion of the cap body by a coupling piece, so that when the cap is removed, the band is removed together with the cap body, the cap body remaining attached to the band by the coupling piece with the coupling piece connecting the inner surface side of the band and the lower surface of the cap body.

2. The open/close cap according to claim 1, wherein the contact preventing portion is formed by extending at least a lower portion in a vertical direction of the cap body.

3. The open/close cap according to claim 1, wherein the band shape maintaining member is composed of a plurality of projections intermittently disposed to the lower end surface of the cap body in a circumferential direction thereof and spaced apart from a corresponding part of the inner surface of the band.

4. The open/close cap according to claim 1, wherein the band shape maintaining member is an annular member projected from the lower end of the cap body, the outermost diameter defining an annular shape free of contact with the band when the band is in a normal, non-deformed state.

5. The open/close cap according to claim 1, wherein the cap body, the band shape maintaining member, the band, the connection piece and the coupling piece are integrally formed as a single piece.

6. The open/close cap according to claim 1, wherein the contact preventing portion comprises a plurality of ribs extending from an outer peripheral surface of the cap body in a circumferential direction, the ribs having a lower end flush with the lower end surface of the cap body and having an outside diameter equal to at least the outer surface of the band, with the outer diameter of the ribs defining the outer diameter of the contact preventing portion.

7. A method of manufacturing an open/close cap which comprises a cap body screwed to an outer peripheral surface of a pouring spout of a packaging container so as to open or close the pouring spout, a band disposed so as to extend in the circumferential direction of the cap body and coupled to the cap body through a coupling piece, and a band shape maintaining member disposed to a lower portion of the cap body and defining a gap between the outer diameter of the band shape maintaining member and the inner diameter of the band, the band shape maintaining member for preventing crushing of the band in a radially inward direction through abutment of the inside portion of the band, and in which the band is provided, in a circumferential direction thereof, with at least one portion at which the band is separated in the circumferential direction, and at which end portions of the band are connected to each other by a connection piece, and the connection piece is cut off in the circumferential direction thereof by a stress caused at a time when the open/close cap is rotated with respect to the pouring spout and a protruded portion projecting toward the pouring spout from the inside of the band rides over a portion of the pouring spout, so that when the cap is removed, the band is removed together with the cap body, the cap body remaining attached to the band by the coupling piece, the coupling piece provided so as to connect the inner surface side of the band and the lower surface of the cap body, the manufacturing method including an injection molding step for integrally molding the cap body, the band shape maintaining member, the connection piece and the coupling piece, wherein in the injection molding step, the band is connected to the cap body by the coupling piece so that a gap between the upper end of the band and the lower end of the cap body is formed to be larger than a dimension between the lower end of the band shape maintaining member and the lower end of the cap body, and also including a pushing step for pushing the band toward the cap body, after the injection of the injection molding step, so that the band is positioned on the outer periphery side of the band shape maintaining member.

8. The open/close cap according to claim 1, wherein, the protruding portion comprises two overlapping trapezoidal protruded portions projecting from the inner surface of the band radially toward a center axis of the cap, there are two of said connection piece, the opening rotation of the cap body produces circumferential tension applied to the band to cut off the connection pieces with the connection pieces being separated in the circumferential direction, and a larger one of the two overlapping trapezoidal protruded portions displacing the band during the opening rotation, and the opening rotation of the cap body removes the cap body and the band from the pouring spout, the cap and band remaining integrally connected by the coupling piece maintaining the cap body integrally connected with the band upon removal from the pouring spout.

9. An open/close cap for opening and closing a pouring spout of a packaging container, the open/close cap comprising:

a cap body having a closed upper surface, an opened lower portion, a screw-shaped male screw formed in an inner surface of the cap body so as to be engageable with an outer peripheral surface of a mouth portion of the pouring spout, the cap body, as viewed from an upper portion of the cap body, i) a cap closing includes the cap body being rotated in the clockwise direction, the cap body being screwed downward and sealing the mouth portion, and ii) a cap opening includes the cap body being rotated in the counterclockwise cap opening direction, the cap body being disengaged from the pouring spout;

a contact preventing portion formed at the lower portion of the cap body, the contact preventing portion having a lower portion protruding radially outward and an outer surface thereof inclined obliquely downward, the contact preventing portion defining a lower end surface of the cap body;

a band provided at the lower portion of the cap body below the contact preventing portion and extending in a circumferential direction of the cap body so as to be engaged with the pouring spout, the band divided into two band pieces;

connection pieces connecting circumferential ends of the two band pieces;

coupling pieces connecting the two band pieces to the lower end surface of the cap body, the coupling pieces disposed on an inner periphery side of the band pieces and the lower surface of the cap body, a first of the coupling pieces disposed on a front side in a cap loosening direction and having a portion with a reduced thickness and width to be cut off at a time when the open/close cap is rotated in the opening direction, a second of the coupling pieces disposed on a rear side in the cap loosening direction having an increased thickness and width so as not to be cut off when the cap is rotated;

claw portions formed on the inner peripheral surface of each of the band pieces, one of the claw portions disposed on a front end portion in the cap loosening direction and the another claw portion disposed to a rear side of the one claw portion in the cap loosening direction, the claw portions protruding from the inner surfaces of the band pieces and inclined in the cap loosening direction with respect to a radial direction directed to a center axis of the cap from the inner surface of the band pieces;

a protruded portion on each band piece projecting from the inner surfaces of the band pieces radially toward the center axis of the cap; and a band shape maintaining member integrally formed on the cap body and projecting downward from a lower end surface of the cap body, the band shape maintaining member positioned to prevent the band from being pushed radially inward of the open/close cap, the band shape maintaining member with an outermost diameter defining a predetermined gap between the band shape maintaining member and an inner surface of the band, the band shape maintaining member extending downward into the band with a lower end of the band shape maintaining member being substantially aligned with a central portion of the band in a height direction, wherein, the opening rotation of the cap body produces circumferential tension applied to the band by the claw portions to cut off the connection pieces with the connection pieces being separated in the circumferential direction, and the protruded portions displacing the band pieces after cutting off the connection pieces during the opening rotation, the opening rotation of the cap body removes the cap body and the band from the pouring spout, the cap and band remaining integrally connected with the first of the coupling pieces being cut off by the opening rotation and the second of the coupling pieces not being cut off by the opening rotation thereby maintaining the cap body integrally connected with the band upon removal from the pouring spout, and with the cap removed, the band shape maintaining member remains entirely with the cap.

10. The open/close cap according to claim 9, wherein, the protruding portions each comprise two overlapping trapezoidal protruded portions projecting from the inner surface of the band radially toward a center axis of the cap, and the opening rotation of the cap body produces the circumferential tension applied to the band to cut off the connection pieces with the connection pieces being separated in the circumferential direction by a larger one of the two overlapping trapezoidal protruded portions displacing the band during the opening rotation.

11. The open/close cap according to claim 1, wherein the band shape maintaining member has an annular shape and has an inner diameter equal to a inner diameter of an adjoining part of the cap body.

12. The open/close cap according to claim 1, wherein the band shape maintaining member extends downward into the band with a lower end of the band shape maintaining member being substantially aligned with a central portion of the band in a height direction.

13. The open/close cap according to claim 1, wherein the band shape maintaining member extends downward into the band with a height approximately ½ a height of the band so that a lower end of the band shape maintaining member is substantially aligned with a central portion of the band in a height direction.

14. The open/close cap according to claim 9, wherein the band shape maintaining member extends downward into the band with a height approximately ½ a height of the band so that a lower end of the band shape maintaining member is substantially aligned with a central portion of the band in a height direction.

* * * * *